United States Patent [19]

Sakurai et al.

[11] Patent Number: 4,537,110

[45] Date of Patent: Aug. 27, 1985

[54] ENVELOPE CONTROL APPARATUS

[75] Inventors: Keiichi Sakurai; Hideaki Ishida; Kohtaro Hanzawa, all of Tokyo, Japan

[73] Assignee: Casio Computer Co., Tokyo, Japan

[21] Appl. No.: 532,504

[22] Filed: Sep. 14, 1983

[30] Foreign Application Priority Data

Sep. 20, 1982 [JP] Japan ..... 57-164518

[51] Int. Cl.[3] ..... G10H 1/057

[52] U.S. Cl. ..... 84/1.26; 84/1.13

[58] Field of Search ..... 84/1.1–1.13, 84/1.19–1.21, 1.26

[56] References Cited

U.S. PATENT DOCUMENTS

| | | | |
|---|---|---|---|
| 3,819,844 | 6/1974 | Isii | 84/1.26 |
| 4,014,238 | 3/1977 | Southard | 84/1.13 |
| 4,185,532 | 1/1980 | Hiyoshi et al. | 84/1.26 |
| 4,253,369 | 3/1981 | Hoskinson | 84/1.26 |
| 4,332,183 | 6/1982 | Deutsch | 84/1.26 |
| 4,333,377 | 6/1982 | Niezgoda et al. | 84/1.26 X |
| 4,418,601 | 12/1983 | Whitefield | 84/1.26 |

FOREIGN PATENT DOCUMENTS 1477113 6/1977 United Kingdom .

*Primary Examiner*—Stanley J. Witkowski

*Attorney, Agent, or Firm*—Frishauf, Holtz, Goodman & Woodward

[57] ABSTRACT

Under the presence of an internally generated mandolin clock (MDN) or an externally generated mandolin clock (MDN'), an envelope clock (ENV-CLK) obtained in accordance with a lower bit output having three-bit signals (including the LSB) is supplied through AND gates to an envelope counter. The counter is set in an up count state in response to an output from a flip-flop set in response to a key on pulse. When a carry signal is generated by the envelope counter, the counter is set in a down count state. In the latter case, the fourth-bit signal from the LSB of the output from the binary counter is gated through the AND gate. The envelope counter counts down the envelope clock (ENV-CLK) having a period twice that of the envelope clock (ENV-CLK) in the up count state.

13 Claims, 4 Drawing Figures

ENVELOPE CONTROL APPARATUS

BACKGROUND OF THE INVENTION

The present invention relates to an envelope control apparatus suitable for producing a mandolin effect in an electronic musical instrument.

In a conventional apparatus for digitally producing a mandolin effect, an envelope counter for generating envelope data is operated when a player depresses a key. When the envelope counter completes counting one period of the envelope, the envelope counter is reset and starts counting again. This count operation is repeated a plurality of times until the player releases the key. As a result, the mandolin effect envelope waveform for a plurality of periods is produced. Therefore, the period of mandolin tone depends on the count cycle of the envelope counter. Unless the period of clock signals supplied to the envelope counter changes, a mandolin effect having an arbitrary period cannot be obtained. As a result, the produced tones become monotonous.

A plurality of apparatus for generating mandolin tones are arranged in an electronic musical instrument for generating a plurality of notes in a time divisional fashion. In this case, different mandolin effects are given to a plurality of notes which are simultaneously produced. Each mandolin effect is obtained by a corresponding one of envelopes having different periods. Therefore, beat noise occurs due to a frequency difference between the envelope waveforms, thus producing poor, uncomfortable sounds.

SUMMARY OF THE INVENTION

It is, therefore, an object of the present invention to provide an envelope control apparatus for giving without beat noise a mandolin effect or the like to a plurality of sounds which are simultaneously generated.

In order to achieve the above object of the present invention, there is provided an envelope control apparatus comprising: clock generating means for repeatedly generating a clock; means for generating an envelope clock; envelope clock counting means for counting the envelope clocks; and means for changing a counting operation of said envelope clock counting means in accordance with clocks of said clock generating means; whereby envelope waveform data changing in accordance with the count content of said envelope clock counting means is generated.

DETAILED DESCRIPTION OF THE PREFERRED EMBODIMENT

Figure 1:
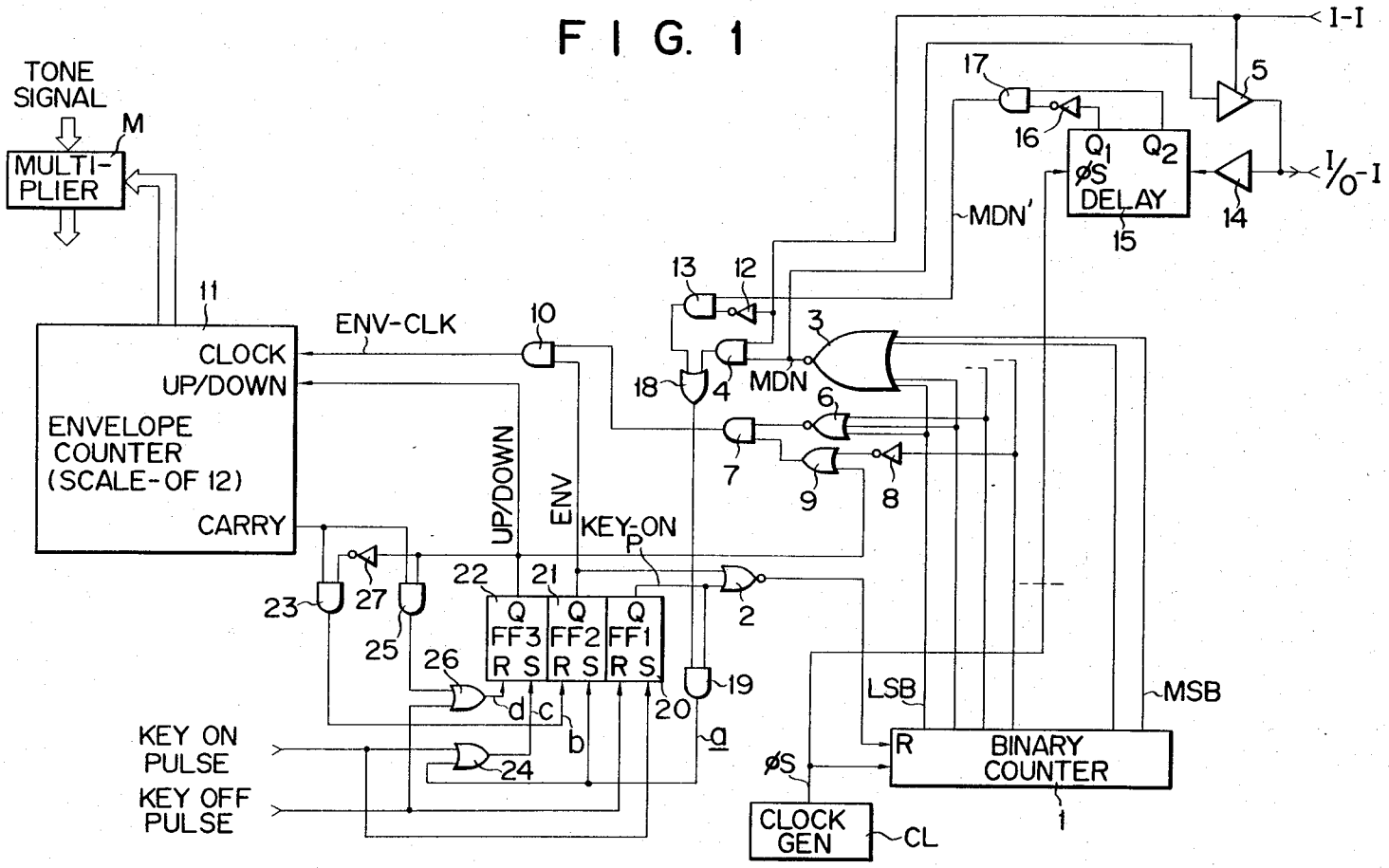
FIG. 1 is a block diagram of an envelope control apparatus according to an embodiment of the present invention.

An envelope control apparatus according to an embodiment of the present invention will be described with reference to the accompanying drawings. FIG. 1 is a block diagram of an envelope control apparatus, as applied to a mandolin effect apparatus formed in an LSI built into an electronic musical instrument.

Referring to FIG. 1, a clock $\phi S$ generated by a clock generator CL is supplied to a binary counter 1. A reset terminal R of the binary counter 1 is coupled to the output terminal of a NOR gate 2. The NOR gate 2 serves to supply a reset signal to the binary counter 1 in accordance with a key-on pulse generated upon depression of a key of a keyboard of the electronic musical instrument to be described later. When the binary counter 1 is reset in response to the reset signal, the binary counter 1 starts counting the clocks $\phi S$.

The bit outputs (from the MSB to the LSB) from the binary counter 1 are supplied to a NOR gate 3. When the bits of the output from the binary counter 1 are set at all "0" or the clock $\phi S$ is supplied to the binary counter 1 having the bit signals which are set at all "1", the NOR gate 3 produces a one-shot pulse (i.e., a mandolin clock MDN). The output terminal of the NOR gate 3 is connected to one input terminal of an AND gate 4 and to the input terminal of a tri-state buffer 5. A lower 3-bit output including the LSB from the binary counter 1 is supplied to the input terminal of a NOR gate 6. Every time the lower 3-bit output described above is set at all "0", the NOR gate 6 produces an output of logic "1". The output terminal of the NOR gate 6 is connected to one input terminal of an AND gate 7. The fourth-bit output from the LSB from the binary counter 1 is supplied to one input terminal of an OR gate 9 through an inverter 8. An output from the OR gate 9 is supplied to the other input terminal of the AND gate 7. The output terminal of the AND gate 7 is connected to one input terminal of an AND gate 10, and the output terminal of the AND gate 10 is connected to a clock input terminal of an envelope counter 11 so as to supply an envelope clock ENV-CLK thereto. In this embodiment, the envelope counter 11 comprises a scale-of-12 or duodecimal counter. The duodecimal counter counts up the envelope clocks ENV-CLK when a control signal supplied to an up/down control terminal is set at logic "1". However, this counter 11 counts down the envelope clocks ENV-CLK when the control signal is set at logic "0".

A control signal of logic "1" or "0" received at an input terminal I-I is supplied to the other input terminal of the AND gate 4. The control signal from the input terminal I-I has a predetermined logic level in accordance with a position of a tone selection switch arranged in a panel of the electronic musical instrument. When the tone selection switch is set in the input mode, the control signal is set at logic "0". However, when the tone selection switch is set in the output mode, the control signal is set at logic "1". The input terminal I-I is also connected to the control input terminal of the tri-state buffer 5 and to an inverter 12. An output from the inverter 12 is coupled to one input terminal of an AND gate 13.

The output terminal of the tri-state buffer 5 is connected to an input/output terminal I/O-I. The input/output terminal I/O-I is connected to a corresponding input/output terminal of at least one mandolin effect apparatus. For example, if the electronic musical instrument produces a polyphonic tone having a maximum of eight tones, a tone generating circuit is provided with 8 channels in accordance with a time division processing scheme. Therefore, two LSI chips each having a mandolin effect apparatus as shown in FIG. 1 are arranged to produce two tones having mandolin effects. In the output mode, the signal of logic "1" is supplied to the input terminal I-I, and the mandolin clock MDN appears at the input/output terminal I/O-I through the tri-state buffer 5 in one LSI chip. The mandolin clock MDN is then supplied to the other LSI chip. The tone having the mandolin effect is produced from the other LSI chip. The tones from these two LSI chips are combined to produce a single tone.

In the input mode, the tri-state buffer 5 is disabled, and an externally generated mandolin clock MDN' is supplied from the other mandolin effect apparatus to the input/output terminal I/O-I. The input/output terminal I/O-I is connected to the input terminal of a delay circuit 15 through a buffer 14. The delay circuit 15 comprises two flip-flops operated in response to the clock S, so that the delay circuit 15 has two set output terminals Q1 and Q2. The set output terminal Q1 is connected to one input terminal of an AND gate 17 through an inverter 16. The set output terminal Q2 is directly connected to the other input terminal of the AND gate 17. The externally produced mandolin clock MDN' received through the AND gate 17 is supplied to the other input terminal of the AND gate 13. The internal and external mandolin clocks MDN and MDN' are supplied together to one input terminal of an AND gate 19 through an OR gate 18.

The other terminal of the AND gate 19 and the one input terminal of the NOR gate 2 are connected to the Q output terminal of an SR flip-flop (FF1) 20. The key on pulse is supplied to the set input terminal of the FF1 20, and a key off pulse is supplied to the reset input terminal thereof. The Q output from the FF1 20 is supplied as a key-on pulse P to the NOR gate 2 and the AND gate 19. The key-on pulse P indicates that the player is continuously depressing the key. An output a from the AND gate 19 is supplied to the set input terminal of an SR flip-flop (FF2) 21 and one input terminal of an OR gate 24. The Q output from the FF2 21 is supplied as a signal ENV to the NOR gate 2 and the AND gate 10. The signal ENV indicates the envelope operation. An output b from an AND gate 23 is supplied to the reset input terminal of the FF2 21.

The key on pulse is also supplied to the other input terminal of the OR gate 24. An output c from the OR gate 24 is coupled to the set terminal of an SR flip-flop (FF3) 22. The key off pulse is supplied as a signal d to the reset terminal of the FF3 22 through an OR gate 26 in response to an output from an AND gate 25. The Q output from the FF3 22 is supplied to the other input terminal of the OR gate 9 and is supplied as an up/down designation signal to the up/down control terminal of the envelope counter 11. The Q output from the FF3 is also supplied to one input terminal of the AND gate 25 and to one input terminal of the AND gate 23 through an inverter 27. A carry signal from the carry terminal of the envelope counter 11 is supplied to the other input terminal of each of the AND gates 23 and 25.

The envelope counter 11 counts up or counts down the envelope clocks ENV-CLK supplied from the AND gate 10, and generates envelope waveform data. The envelope waveform data is supplied to a multiplier M and is multiplied by a tone signal. The composite tone signal is produced as a musical sound having a mandolin effect through a D/A converter, an amplifier and a loudspeaker in the order mentioned.

The operation of the envelope control apparatus having the arrangement described above will be described with reference to the timing charts in FIG. 2 to FIG. 4. When the player selects a desired tone selection switch on the panel, a corresponding control signal of level "1" is supplied to the input terminal I-I of the LSI chip shown in FIG. 1. The tri-state buffer 5 is turned on, the AND gate 4 is enabled, and the AND gate 13 is disabled.

Figure 2:
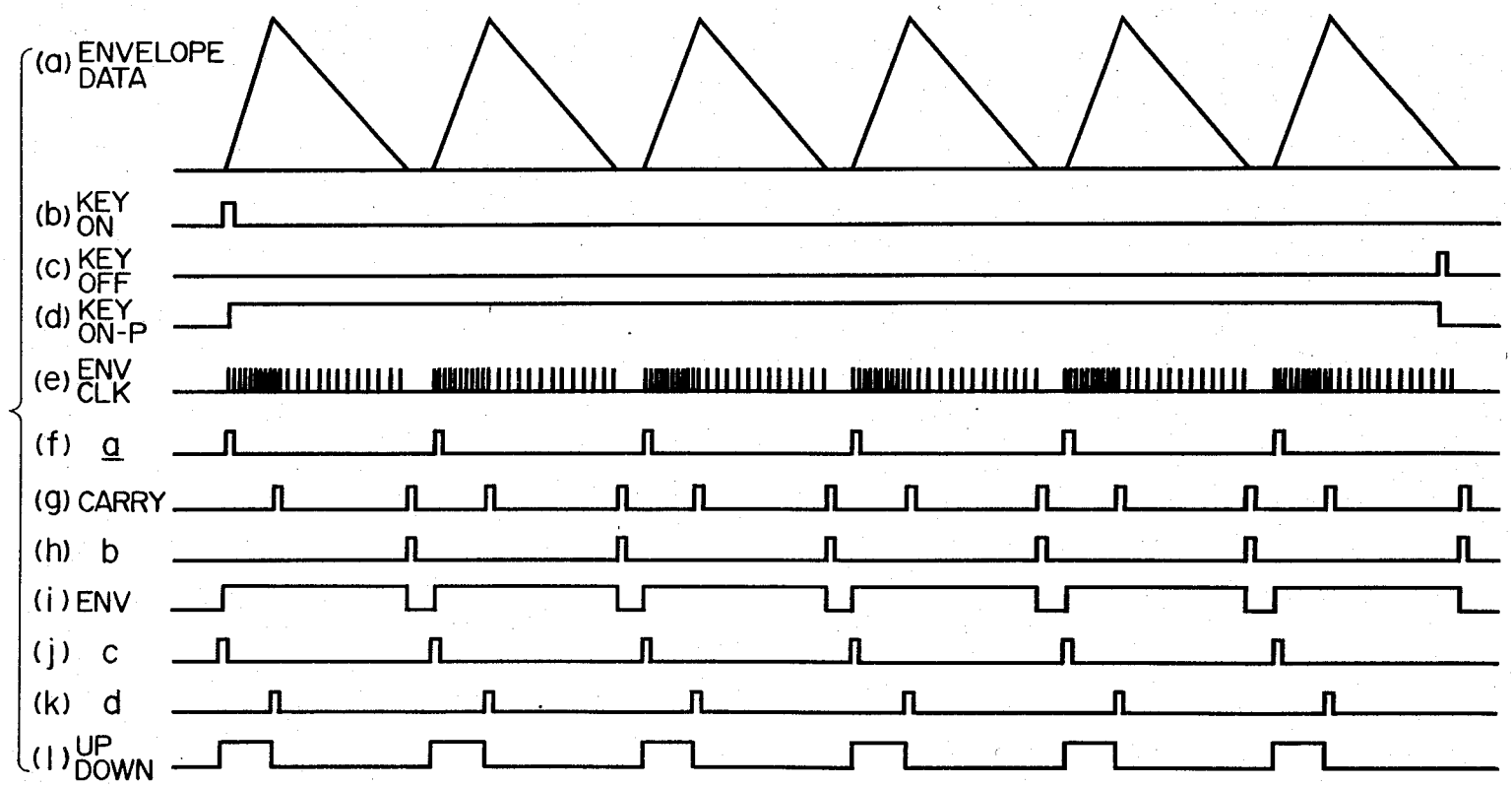
FIG. 2, FIG. 3 and FIG. 4 are timing charts for explaining the operation of the apparatus shown in FIG. 1, respectively.

When the player depresses a given key and a key on signal is supplied to a given channel of the tone generator, the one-shot key on pulse "1" is produced, as shown in FIG. 2(*b*). The FF1 20 and the FF3 22 are set. As a result, the key on pulse P as the set output of the FF1 20 goes to level "1" as shown in FIG. 2(*d*), and the output from the NOR gate 2 goes to level "0". The resetting state of the binary counter 1 is released in synchronism with the trailing edge of the output from the NOR gate 2. The binary counter 1 starts counting the clocks $\phi$S. The AND gate 19 is disabled after the key is depressed. Therefore, since the count of the binary counter 1 is zero upon key depression, the one-shot pulse (mandolin clock MDN of level "1") is supplied from the NOR gate 3 to the other mandolin effect apparatus through the tri-state buffer 5 and the input/output terminal I/O-I, and to the AND gate 4. In this condition, the AND gates 4 and 19 are enabled, so that the one-shot pulse a (FIG. 2(*f*)) is produced from the AND gate 19 in synchronism with the mandolin clock MDN. As a result, the FF2 21 is set, and the signal ENV (FIG. 2(*i*)) as the set output signal therefrom goes to level "1", and thereafter the AND gate 10 is enabled.

The up/down signal (FIG. 2(*l*)) as the set output from the FF3 22 goes to level "1" after the key on pulse is generated. The up-count designation signal is supplied to the up/down control terminal of the envelope counter 11. The AND gate 7 is enabled, the AND gate 23 is disabled, and the AND gate 25 is enabled.

Meanwhile, the binary counter 1 counts the clocks $\phi$S. When the lower 3-bit output from the binary counter 1 is set at all "0", the NOR gate 6 supplies a one-shot pulse to the AND gate 7. Therefore, a clock synchronized with the pulse signal from the NOR gate 6 is supplied as the envelope clock ENV-CLK (FIG. 2(*e*)) to a clock terminal of the envelope counter 11 through the AND gate 7 which is enabled in response to the up/down signal of level "1" and the AND gate 10 which is enabled in response to the signal ENV. The envelope clock ENV-CLK is thus counted by the envelope counter 11.

Every time the envelope clock ENV-CLK is generated, the count of the envelope counter 11 is incremented by one. The value of the envelope waveform data which indicates an amplitude of the output signal is increased, as shown in FIG. 2(*a*). When 11 envelope clocks ENV-CLK have been supplied to the envelope counter (duodecimal counter) 11, and the 12th envelope clock ENV-CLK is supplied thereto (i.e., the count of the envelope counter 11 has reached the maximum value corresponding to a maximum amplitude), the envelope counter 11 generates a carry signal from its carry terminal. The carry signal (FIG. 2(*g*)) allows generation of a signal d (FIG. 2(*k*)) of level "1", so that the FF3 22 is reset. Thereafter, the up/down signal of level "0" is generated. The AND gate 23 is enabled, the AND gate 25 is disabled, and a down count designation signal is supplied to the envelope counter 11.

When the up/down signal is set at level "0", the down count operation is started. The output from the OR gate 9 then goes to level "1" in response to the output of level "1" from the inverter 8, while the fourth-bit output from the binary counter 1 is set at level "0". The period of the envelope clock ENV-CLK during the down count operation is twice that during the up count operation. Therefore, the down count operation is performed at a low rate (½ of the frequency of the up count operation), and the amplitude represented by the envelope waveform data during the down count operation is decreased at a rate half that of the up count operation. When the count of the envelope counter 11 becomes zero and the carry signal of level "1" is generated by the envelope counter 11, the signal b (FIG. 2(*h*)) from the AND gate 23 goes to level "1", and the FF2 21 is reset. As a result, the signal ENV goes to level "0".

When the count of the binary counter 1 is reset to zero, the one-shot mandolin clock MDN is generated. Therefore, the signal a of level "1" is supplied to the FF2 21, and an output C of OR gate 24 as shown in FIG. 2(*j*) is supplied to the FF3 22, which are then set. The signal ENV and the up/down signal simultaneously go to level "1", and the key on pulse output state is restored.

The envelope waveform data of one period is thus produced during the above operation. The envelope waveform data is then supplied to the multiplier M and is multiplied with a frequency signal corresponding to the depressed key. As a result a tone having a mandolin effect can be produced. The control signal of level "0" is supplied to an input terminal corresponding to the input terminal I-I of the mandolin effect apparatus shown in FIG. 1. In this case, the tri-state buffer 5 is turned off, the AND gate 4 is disabled, and the AND gate 13 is enabled. Therefore, the mandolin effect apparatus as controlled cannot be driven by the internal mandolin clock MDN, but only by the external mandolin clock MDN′ which is generated by another like mandolin effect apparatus and which is supplied through the input/output terminal I/O-I. When the depressed key is released, a key-off signal, as shown in FIG. 2(*c*), is generated.

Figure 3:
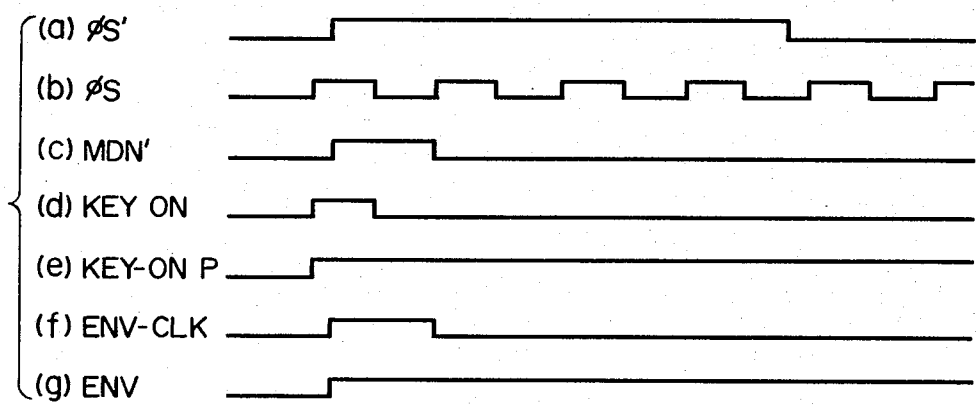

When the player depresses a key, and a given channel is assigned to the key on signal, a key on pulse of level "1" is generated, as shown in FIG. 3(*d*). In response to this signal, the external mandolin clock MDN′ generated by the other mandolin effect apparatus is supplied to the input/output terminal I/O-I. The mandolin clock MDN′ is supplied to the delay circuit 15 through the buffer 14. The delay circuit 15 is driven in response to the clock $\phi$S shown in FIG. 3(*b*). As a result, the mandolin clock MDN′ is produced from the AND gate 17, as shown in FIG. 3(*c*). The mandolin clock MDN′ is then supplied to the OR gate 18 through the AND gate 13.

Now assume that the envelope value reaches a maximum value in response to the first clock $\phi$S and decreases in response to second and subsequent clocks $\phi$S. As shown in FIG. 3(*a*), when a clock $\phi$S′ has a frequency lower than that of the clock $\phi$S, the clock $\phi$S′ is supplied as the mandolin clock MDN′ to the FF3 22 through the AND gate 13, the OR gate 18, the AND gate 19 and the OR gate 24. Meanwhile, two carry signals are produced from the carry terminal of the envelope counter 11. The waveform of the resultant tone signal is different from that of the original signal. When the clock $\phi$S′ has a frequency lower than that of the clock $\phi$S, the delay circuit 15 shapes the waveform of the clock $\phi$S′. Any other circuit operation of the circuit shown in FIG. 1 is the same as that in the output mode. The waveforms of the key on pulse P, the envelope clock ENV-CLK and the signal ENV are shown in FIGS. 3(*e*), 3(*f*) and 3(*g*), respectively.

Figure 4:
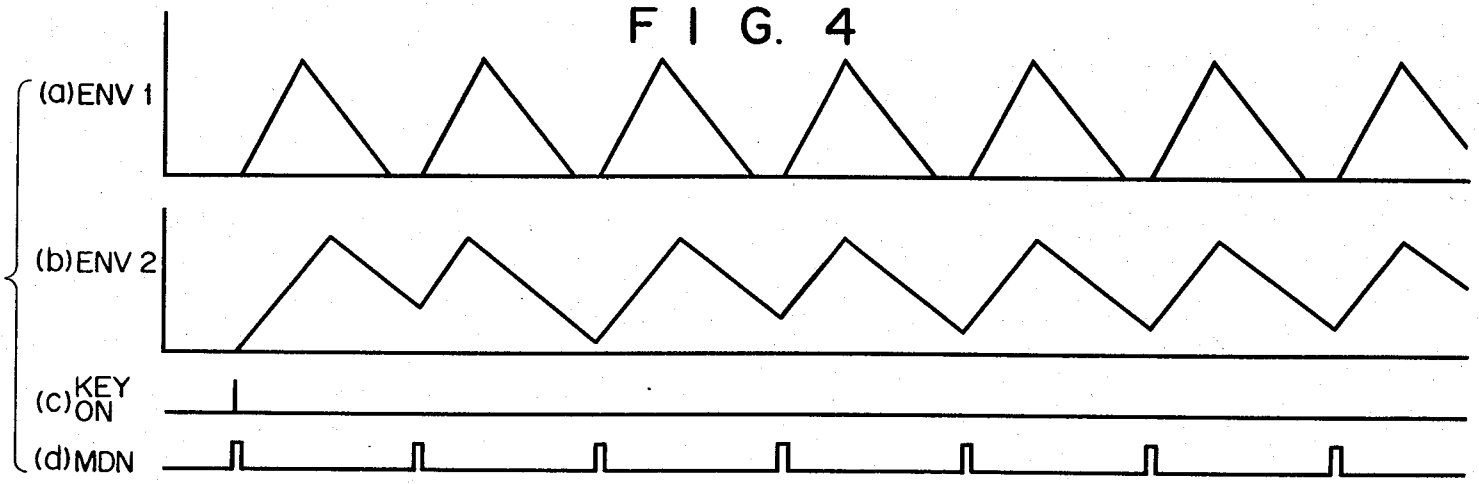

FIG. 4 shows that the two mandolin effect apparatuses are operated in synchronism with each other and that they produce tones having independent mandolin effects, respectively. One of the envelope waveforms has a period shorter than that of the mandolin clock, and the other has a period longer than that of the mandolin clock.

In the above embodiment, two tones having different mandolin effects are produced from the two mandolin effect apparatus, and are combined to produce a composite tone having a mandolin effect. However, the number of mandolin effect apparatus is not limited to the number in the above embodiment. For example, three mandolin effect apparatus may be used to produce three tones having different mandolin effects, and thereafter these tones are combined to produce a single tone having a mandolin effect.

As has been apparent from the above description, mandolin effect apparatus operated in synchronism with each other can produce tones having different mandolin effects, respectively. Therefore, even if a single tone obtained by combining a plurality of mandolin effects is produced, no beat noise is produced, and a rich musical expression can be provided.

What is claimed is:

1. An envelope control apparatus comprising:

clock pulse generating means for generating clock pulses of a predetermined cycle in response to continued operation of a key;

envelope clock pulse counting means for counting clock pulses generated by said clock pulse generating means;

means for forming envelope waveform data defining a complete envelope waveform which varies in accordance with the count of said envelope clock pulse counting means; and changing means for changing the state of said envelope clock pulse counting means to a counting state corresponding to an attack state of the envelope waveform when the clock pulses of said predetermined cycle are supplied from said clock pulse generating means to said changing means;

wherein new envelope waveform data defining a new complete envelope waveform is generated by said envelope waveform data forming means prior to formation of one envelope waveform.

2. An apparatus according to claim 1, wherein said counting state changing means comprises:

memory means having a first status in accordance with a key on signal of a performance key and said clock pulse generated from said clock pulse generating means; and wherein, when said memory means is in said first status, said envelope counting means is set in the up counting status, and when a carry signal is generated from said envelope counting means, said memory means is brought in a second status to set said envelope counting means in a down count status.

3. An apparatus according to claim 1, wherein said changing means comprises:

a first OR gate supplied with a key on pulse of a performance key and said clock pulse generated from said clock pulse generating means;

a first flip-flop set by an output of said first OR gate;

a second flip-flop set by said clock generated from said clock pulse generating means and reset by a carry signal of said envelope clock counting means; and a third flip-flop set by said key on pulse and reset by a key off pulse.

4. An apparatus according to claim 1, including means associated with said envelope waveform data forming means for generating an envelope clock pulse, and wherein the period of the envelope clock pulse generated from said envelope clock pulse generating means in an up count period of said counting means is different from that in a down count period.

5. An apparatus according to claim 4, wherein the period of the envelope clock generated from the envelope clock generating means is shorter in the up count period than that in the down count period.

6. An envelope control apparatus, comprising:

clock pulse generating means for generating clock pulses of a predetermined cycle in response to continued operation of a key;

envelope clock pulse counting means for counting clock pulses generated by said clock pulse generating means;

means for forming envelope waveform data defining a complete envelope waveform which varies in accordance with the count of said envelope clock pulse counting means;

changing means for changing the state of said envelope clock pulse counting means to a counting state corresponding to an attack state of the envelope waveform when said clock pulses of said predetermined cycle are supplied from said clock pulse generating means to said changing means so that new envelope waveform data defining a new complete envelope waveform is generated prior to formation of one envelope waveform; and means for receiving another clock pulse of another predetermined cycle from an external circuit and for supplying said other clock pulse to said changing means in substitution of the clock pulse generated by said clock pulse generating means.

7. An apparatus according to claim 6, wherein said clock pulse generating means includes:

a counter for counting basic clocks; and gating means for detecting when an output of said counter satisfies a predetermined condition, the output of said gating means being used as said clock.

8. An apparatus according to claim 7, wherein said envelope clock pulse generating means includes second gating means for receiving predetermined bit outputs of said counter, the output of said second gating means being given as said envelope clock pulse.

9. An apparatus according to claim 7, wherein said envelope clock pulse generating means comprises:

a NOR gate supplied with a plurality of lower bit outputs of said counter;

a first OR gate supplied with at least one bit output higher than said plurality of lower bit outputs; and means for supplying as said envelope clock pulse the outputs of said NOR gate and said first OR gate.

10. An apparatus according to claim 6, wherein said counting state changing means comprises:

memory means having a first status in accordance with a key on signal of a performance key and said clock pulse generated from said clock pulse generating means; and wherein, when said memory means is in said first status, said envelope counting means is set in the up counting status, and when a carry signal is generated from said envelope counting means, said memory means is brought in a second status to set said envelope counting means in a down count status.

11. An apparatus according to claim 6, wherein said changing means comprises:

a first OR gate supplied with a key on pulse of a performance key and said clock pulse generated from said clock pulse generating means;

a first flip-flop set by an output of said first OR gate;

a second flip-flop set by said clock pulse generated from said clock pulse generating means and reset by a carry signal of said envelope clock counting means; and a third flip-flop set by said key on pulse and reset by a key off pulse.

12. An apparatus according to claim 6, wherein the period of the envelope clock pulse generated from said envelope clock pulse generating means in an up count period of said counting means is different from that in a down count period.

13. An apparatus according to claim 12, wherein the period of the envelope clock generated from the envelope clock generating means is shorter in the up count period than that in the down count period.

* * * * *

UNITED STATES PATENT AND TRADEMARK OFFICE

CERTIFICATE OF CORRECTION

PATENT NO. : 4,537,110

DATED : August 27, 1985

INVENTOR(S) : Keiichi SAKURAI et al

It is certified that error appears in the above-identified patent and that said Letters Patent is hereby corrected as shown below:

In the heading of the patent, change the name of the Assignee from "Casio Computer Co." to --Casio Computer Co., Ltd.--

Signed and Sealed this

*Ninth* Day of *September 1986*

[SEAL]

*Attest:*

DONALD J. QUIGG

*Attesting Officer*

*Commissioner of Patents and Trademarks*